US006228966B1

(12) United States Patent
Neuert

(10) Patent No.: US 6,228,966 B1
(45) Date of Patent: May 8, 2001

(54) HIGH-STRENGTH HIGH-MODULUS POLYACRYLONITRILE FIBERS, METHOD FOR THEIR PRODUCTION AND USE

(75) Inventor: Richard Neuert, Winkelhaid (DE)

(73) Assignee: Acordis Kehlheim GmbH, Kehlheim (DE)

( * ) Notice: Subject to any disclaimer, the term of this patent is extended or adjusted under 35 U.S.C. 154(b) by 0 days.

(21) Appl. No.: 09/319,645

(22) PCT Filed: Dec. 9, 1997

(86) PCT No.: PCT/EP97/06862

§ 371 Date: Jun. 9, 1999

§ 102(e) Date: Jun. 9, 1999

(87) PCT Pub. No.: WO98/26116

PCT Pub. Date: Jun. 18, 1998

(30) Foreign Application Priority Data

Dec. 11, 1996 (DE) ..... 196 51 440

(51) Int. Cl.[7] ..... C08F 20/44
(52) U.S. Cl. ..... 526/341; 524/222
(58) Field of Search ..... 524/222; 526/341

(56) References Cited

U.S. PATENT DOCUMENTS 4,447,568 * 5/1984 Stern ..... 524/101
4,658,004 * 4/1987 Kobashi ..... 526/341

FOREIGN PATENT DOCUMENTS

| | | |
|---|---|---|
| 0044534 | 1/1982 | (EP) . |
| 0061117 | 9/1982 | (EP) . |
| 0165372 | 12/1985 | (EP) . |
| 0213772 | 3/1987 | (EP) . |
| 0377813 | 7/1990 | (EP) . |
| 0645479 | 3/1995 | (EP) . |
| 0255109 | 3/1998 | (EP) . |
| 1193170 | 5/1970 | (GB) . |

OTHER PUBLICATIONS

Soviet Contributions to Fiber Research and Textile Technology, vol. 98, pp. 407–411 (1972).
Synthetic Fibers, Falkai et al., p. 200 (1981), Verlag Chemie.

* cited by examiner

*Primary Examiner*—Paul R. Michl
(74) *Attorney, Agent, or Firm*—Frommer Lawrence & Haug LLP

(57) ABSTRACT

This invention describes high-strength fibers with high initial moduli from homopolymers or copolymers comprising at least 70% by weight repeating acrylonitrile and/or methacrylonitrile units, and a process especially adapted for their preparation, and their use, especially as reinforcing materials or for producing filters or friction coatings. The fibers according to the invention have a strength of more than 100 cN/tex and an initial modulus of more than 15 N/tex (based on 100% elongation).

35 Claims, No Drawings

HIGH-STRENGTH HIGH-MODULUS POLYACRYLONITRILE FIBERS, METHOD FOR THEIR PRODUCTION AND USE

This invention concerns fibers of homopolymers or copolymers comprising repeating acrylonitrile and/or methacrylonitrile units (called PAN fibers hereinafter) with high modulus and high strength, as well as a process specially adapted for producing them, and their use, especially as reinforcing materials or for production of filters, ropes or friction coatings.

High-strength PAN fibers per se are known. For instance, Dobrecov et al. described high-strength PAN fibers with high modulus, derived from high-molecular-weight types of PANs (e. g., molecular weights of $3 \cdot 10^6$) in Sowjet. Beiträge zur Faserforschung und Textiltechnik [Soviet Contributions to Fiber Research and Textile Technology], Vol. 9, pages 407–411 (1972).

Fibers with strengths of more than 8.83 cN/dtex and processes for preparing them are known from European Patent Applications 0,165,372 and 0,255,109. High-molecular-weight types of PANs are also used to produce them. According to EP-A 0 255 109, PAN types with a molecular weight greater than 500,000 (weight average) are used, while according to EP-A 0165 372, PAN types with a limiting viscosity greater than 2.5 are used. That corresponds to a molecular weight of more than 210,000 (weight average).

In the documents mentioned above, PAN types with unusually high molecular weight are used without exception. The usual values of the molecular weight of PAN fibers is about 80,000 to 180,000 (cf. the comments of Falkai et al. in "Synthesefasern" [Synthetic Fibers], page 200, Verlag Chemie (1981), or of Masson et al. in "Fiber Producer", June 1984, pages 34–37).

Use of the high-molecular-weight PAN types reported in those documents entails problems in producing those fibers. Because of the lower solubility of the high-molecular-weight PAN types, the concentration of the spinning dope must be reduced to produce the spinning dope. For instance, in processing PAN types of lower molecular weight it is possible to work with concentrations of 19 to 21%. In the documents above, though, the work is done with reduced concentrations of not more than 10–15%. That means a substantial productivity loss of 25–70% for a production plant. According to EP-A 0 165 372, the processing is done with a concentration of 6–12% in the spinning dope (Examples 5–7). That means a productivity loss of 45–70%.

Furthermore, the residence time for dissolving the PAN in the solvent becomes considerably longer as the molecular weight of the polymer increases. New installations must be built for dissolving in order to retain effectiveness in the dissolution process. Usually additional measures must be taken in order to be able to work at higher concentrations of the spinning dope. In EP-A 0 255 109 an attempt is made to reduce the viscosity by adding 1–10% water to the spinning solution so as to be able to work with higher concentration. But that is linked with danger of corrosion in the plant and that measure allows only limited reduction of the viscosity.

High-strength PAN fibers produced with PAN types having the usual molecular weights are already known. For instance, GB-A 1,193,170 describes PAN fibers which exhibit strengths up to 17.5 g/denier. To be sure, the elongation to break of the fibers described, more than 15%, is too high for many uses.

High-strength PAN fibers with high modulus are known from EP-A 0 044 534. They are also produced with PAN types with the usual molecular weight. Fibers are described with strengths up to 81 cN/tex or with initial moduli up to 1989 cN/tex. PAN fibers with strengths greater than 100 cN/tex and, at the same time, initial moduli greater than 15 N/tex (based on 100% elongation) are not described in this document.

PAN fibers with strength up to 100 cN/tex and with initial modulus up a maximum of 21.5 N/tex are known from EP-A 0 645 479. PAN fibers with strengths greater than 100 cN/tex and, at the same time, initial moduli greater than 15 N/tex (based on 100% elongation) are not described in this document.

PAN fibers are popular reinforcing materials in aggressive environments because of their high resistance, especially to highly alkaline environments or to UV radiation. High strengths and high initial moduli at low elongations to break are particularly desired for industrial applications. There is a need for PAN fibers with such a property profile, and especially for PAN fibers that can be obtained from processes with high productivity.

The subject of this invention is fibers of homopolymers or copolymers comprising at least 70% by weight repeating acrylonitrile and/or methacrylonitrile units, characterized in that the fibers have a strength of more than 100 cN/tex and an initial modulus greater than 15 N/tex, based on 100% elongation.

Precipitation or solution polymers produced by the usual processes can be used as polymer raw materials. Both homopolymers and copolymers of acrylonitrile are used, depending on the requirements for the application. Care should be taken for the highest possible purity in the monomers used. Particularly suitable comonomers include all the unsaturated compounds that can be copolymerized with acrylonitrile, especially unsaturated carboxylic acids such as acrylic acid, methacrylic acid or itaconic acid; unsaturated sulfonic acids such as allyl, methallyl, or styrene sulfonic acid; unsaturated carboxamides such as acrylamide or methacrylamide; esters of unsaturated carboxylic acids, such as the methyl, ethyl, propyl, butyl, or octyl ester of acrylic acid or methacrylic acid, or polyfunctional hydroxyethyl or aminoethyl esters of acrylic acid or methacrylic acid, or their derivatives; esters of carboxylic acids with unsaturated alcohols or ethers based on unsaturated alcohols, such as vinyl esters and ethers, for instance, vinyl acetate, vinyl stearate, vinyl butyrate, vinyl bromoacetate, vinyl dichloracetate, or vinyl trichloracetate; unsaturated aldehydes or ketones, such as acrolein or crotonaldehyde; acid halides of unsaturated carboxylic acids, such as acrylic acid chloride or methacrylic acid chloride; or other monomers which can be copolymerized with acrylonitrile, such as styrene, butadiene, propylene or vinyl halides, such as vinyl chloride, vinylidene dichloride, or vinyl bromide.

Preferred monomers which can be used for copolymerization are acrylic acid or methacrylic acid esters of $C_1$–$C_{22}$ alcohols, such as methyl acrylate, methyl methacrylate, butyl methacrylate, octyl methacrylate, ethyl acrylate, isobutyl acrylate, (meth)acrylic acid esters of perfluorinated $C_1$–$C_{22}$ alcohols; vinyl-aromatics with up to 20 carbon atoms, e.g., styrene or vinyl toluene; esters of maleic acid and of fumaric acid with $C_1$–$C_{22}$ alcohols; vinyl chloride, vinyl acetate, ethylene, and butadiene. Methyl acrylate is preferred.

Other functional monomers which can copolymerize with acrylonitrile or methacrylonitrile can also be used. The functional monomers can contain hydroxy, silane, or epoxy groups. Examples of those are vinyl trimethoxysilane, vinyl tributoxysilane, methacryloxypropyltrimethoxysilane, vinyl-tris-(methoxyethoxy)silane, vinyl triacetoxysilane, hydroxyethyl methacrylate, hydroxybutyl methacrylate, glycidyl acrylate, glycidyl methacrylate, or 2-hydroxyethyl acrylate.

Other suitable acrylonitrile polymers are SAN, ABS and NBR copolymers, in which the acrylonitrile proportion should have the weight percentage specified previously.

It is preferable for the polymers used to contain at least 90% by weight and especially preferably at least 99% by weight acrylonitrile units.

Very specially, polyacrylonitrile homopolymers or copolymers with molecular weights (weight-average) of 80,000 to 210,000, preferably 175,000 to 210,000 are used.

The strengths of the fibers according to the invention are more than 100 cN/tex, preferably 101 to 150 cN/tex.

The initial moduli, based on 100% elongation, of the fibers according to the invention are more than 15 N/tex, preferably 22 to 35 N/tex, and very specially preferably 22–30 N/tex.

The tensile strength at break of the fibers according to the invention is more than 85 cN/tex, preferably more than 90 cN/tex, at an elongation to break not more than 15%, preferably 7 to 9%.

Furthermore, fibers as defined above exhibiting knot strengths more than 15 cN/tex, especially 17 to 20 cN/tex, are preferred.

The individual filament denier of the fibers according to the invention vary from 0.3 to 100 dtex, preferably 0.9 to 20 dtex, depending on the application. Deniers in the range of 1.0 to 3 dtex are preferred in textile applications.

It was found, in the course of the development, that such high-strength PAN fibers can also be produced with high productivity if certain process conditions are maintained. In particular, PAN fibers of the type described above, i.e., with strengths greater than 100 cN/tex and initial moduli more than 15 N/tex, based on 100% elongation, can be obtained if the spinning pressure of the spinning dope at the spinning orifice is at least 20 bar, preferably at least 30 bar.

Thus the invention concerns a process for producing high-strength fibers of a homopolymer or copolymer containing at least 70% by weight of acrylonitrile and/or methacrylonitrile units, comprising the following measures:

a) preparation of a spinning solution comprising an organic aprotic solvent or a mixture of such a solvents and at least 15% by weight, based on the spinning solution, of a homopolymer or copolymer containing at least 70% by weight of repeating acrylonitrile and/or methacrylonitrile units.

b) spinning this spinning solution by a wet spinning process or a dry jet-wet spinning process into a coagulation bath, in which process the spinning pressure of the spinning solution at the orifice is at least 20 bar.

c) coagulation of the spun fibers in the coagulation bath and drawing these fibers out of the coagulation bath, and d) post-treatment of the spun fibers by one or more drawing steps, in which the degree of drawing between the take-up of the spun fibers out of the coagulation bath and the exit of the post-treatment section is at least 1:10.

Any organic aprotic solvent or a mixture of such solvents can be used as the spinning solvent. Examples of such solvents are dimethyl sulfoxide (DMSO), dimethylacetamide (DMAC), N-methylpyrrolidone (NMP) and, especially, dimethylformamide (DMF).

Classical processes and machines can be used to prepare the spinning solution. In the process according to the invention the concentration of the spinning dope is at least 15%, preferably more than 26%, and especially 29 to 38%. If concentrations less than 15% are used, problems can occur at the orifice. That is, irregularities occur at the orifice during spinning, and adhesions can occur as a result. Furthermore, the productivity of the post-treatment line decreases directly as the concentration in the spinning dope decreases. The viscosity of the spinning solution is at least 150 Pa.s, preferably 260 to 450 Pa.s (determined at 80° C. in DMF).

The spinning solution is usually filtered, and, if necessary, degassed, before spinning. That removes gel particles and contaminants which may be present. Filtration is very important in the process according to the invention because that procedure can reduce substantially the failure rate in spinning and post-treatment. Spinning failures can cause winding on the drawing rolls later in contact and wet drawing of the fibers.

The filtration can be performed with the equipment well known for that purpose, as with filter presses, in which the material to be spun is pressed through several compact layers of cloth. Two-stage or multi-stage high-pressure filtration using filter boxes with support pipes (pressure >30 bar) is preferred. The "pore size" is a measure of the filtering action, it is the upper limit for the diameter of particles which pass through the filter.

Filters with 5 to 15 $\mu$m pores are used preferably for spinning solutions with DMF as the solvent. This means that particles with diameters less than 5 to 15 $\mu$m can still pass through the filter. If the spinning dope is not filtered properly, i.e., if spinning solutions with DMF as the solvent are filtered with filters with a pore size than 15 $\mu$m, later production problems must be expected.

The filtration temperature is preferably between 80 and 90° C. for DMF spinning solutions.

The exit speed where the fibers leave the spinning orifice or spinning speed must be selected so that the fibers practically do not bend on immersion into the liquid, and so that they retain their previous direction of movement. The exit velocity of the spinning solution can be varied from less than 5 meters/minute to 50 meters/minute. 15 to 35 meters/minute are preferred.

The spinning speed S, is calculated from the following equation:

$$S = \frac{4 \cdot F}{Z \cdot d^2 \cdot \pi}$$

in which

S=spinning speed (meters/minute)

F=feed rate ($cm^3$/minute)

Z=number of orifices in the nozzle d=orifice diameter (mm).

Because of the high spinning speed and the high spinning pressure, the spun fibers enter the coagulation bath, or pass through the surface of the coagulation bath, without marked change in direction. If the direction of the fibers changes significantly on entering the coagulation bath, one must expect the fibers to stick to each other and to the surface of the nozzle. The direction of motion of the fibers can change in the coagulation bath.

Because of the high injection velocity and the relatively high viscosity of the highly concentrated spinning solution, a high pressure can develop in the spinning nozzle. This high pressure is essential to attain high strengths. Because of the high concentration, the process can be operated very economically with high productivity. One disadvantage, though, is that spinning problems can arise because of the high pressure. These are expressed, for instance, in spattering of the spinning nozzle (adhesion of droplets of the spinning composition to the nozzle). It is desirable, therefore, to increase the temperature of the spinning solution before it passes through the spinning nozzle if such problems appear, so as to reduce the viscosity of the spinning dope. Therefore, if DMF is used as the spinning solvent, it is desirable to heat the spinning solution to at least 80 to 100° C. briefly before it enters the nozzle.

Spinning solution temperatures below 100° C. can cause the problems depicted above. If the temperature of the composition being spun is above 130° C. one must expect evaporation of the DMF and yellowing of the dope. With DMF, then, one works preferably with spinning solution temperatures of 80 to 130° C. ahead of the spinning nozzle.

The spinning pressure of at least 20 bar specified above refers to the heated spinning solution, the temperature of which is in the range of 80 to 130° C.

The correct choice of the nozzle orifice diameter has a major effect on the clean and satisfactory entrance of the fibers into the coagulation bath. The high spinning speeds required in the process according to the invention are difficult to achieve, especially if large orifice diameters are selected. In this case, one must expect problems in spinning and spattering of the spinning nozzle. If such problems occur, in a particular case, it is recommended that the orifice diameter be reduced.

Behavior on injecting the fiber into the liquid of the coagulation bath can also be affected by the choice of the fiber thickness. As already mentioned, the fibers must be forced into the coagulation bath under conditions such that the fibers do not bend and lose their previous velocity on immersion in the liquid. That can also be affected by the choice of the diameters of the nozzle orifices.

The nozzle orifice diameters are typically less than 150 $\mu$m; they are preferably 60 to 120 $\mu$m.

Spinning can be done by the wet spinning process or the dry jet-wet spinning process, which are themselves known. The spinning nozzle can be immersed in the coagulation bath, or the spinning nozzle is placed a specified distance above the surface of the coagulation bath, so that the spinning is done in an air gap. The distance between the spinning nozzle and the surface of the coagulation bath can be varied over a wide range. The distance is preferably less than 10 millimeters, especially 1 to 10 mm.

The coagulation bath is generally an aqueous mixture containing an aprotic organic solvent, for instance, a solution, dispersion, or suspension of this aprotic organic solvent in water. It is preferable for the aprotic organic solvent in the coagulation bath to be identical to the selected spinning solvent.

The concentration of the aprotic organic solvent must be selected, in a particular case, so that coagulation is fast enough and complete enough. When working with relatively highly concentration spinning solutions, care must be taken that the concentration of the aprotic organic solvent in the coagulation bath is not too high, or does not become too high. If the concentration of the aprotic organic solvent in the coagulation bath is selected too high, the fibers can stick to the take-up reel, as complete coagulation of the fiber is not assured.

Typically, one works with aprotic organic solvent concentrations less than 75% by weight, preferably less than 50% by weight, and especially 20 to 50% by weight (based on the solution in the coagulation bath).

The temperature of the coagulation bath is from 20 to 110° C., preferably 40 to 90° C., and especially preferably 60 to 85° C.

The length of the coagulation bath depends on the spinning speed, and is at least 0.5 meter. In any case, the length of the coagulation bath must be selected so as to achieve enough coagulation for the subsequent post-treatment.

The post-treatment of the fibers is done after the coagulation. That can be done with a post-treatment system which is itself known.

It was found, surprisingly, that PAN fibers which can be very highly drawn can be obtained by spinning according to the invention. To produce high-strength PAN fibers, the spun fibers are post-treated with one or more drawing steps, whereby the total draw ratio between the take-up from the coagulation bath and the exit from the post-treatment segment is at least 1:10, and preferably 1:10 to 1:25.

In the post-treatment, the fibers can, for example, be washed one or more times after they leave the coagulation bath, in which case some further coagulation can still occur in those steps. Usually the fiber is wet-drawn and/or revived during at least one washing step. The fiber is usually dried after washing. Then the fibers are post-drawn in a further drawing step. That can be done by drawing in a hot air bath and/or by contact drawing, over heated rolls, for instance, such that the drawing ratio is at least 1:1.5 in the case of contact drawing. Then the fibers are preferably drawn off under tension. It is also possible and preferred to fix the drawn fibers in conjunction with the post-drawing. That is advantageously accomplished by heating to temperatures of 130 to 350° C., preferably 150 to 250° C. in a normal atmosphere. This fixing stabilizes the PAN fibers and their density increases from about 1.18 g/cm$^3$ to more than 1.2 g/cm$^3$. This rise in density can involve a partial loss of strength.

After that the fibers can be taken to a cutter, or the fibers are further processed as filaments, being wound up, for instance.

Such post-treatments of PAN fibers are themselves known and are described, for instance, in EP-A 0 044 534, EP-A 0 165 372 and EP-A 0 255 109.

The PAN fibers according to the invention can be used in quite varied applications. They are typically used for industrial purposes. Examples include use as reinforcing materials in production of composites, as in production of fiber-reinforced thermoplastic or thermosetting plastics, or, especially, for production of fiber-reinforced hydraulically setting materials, as in concrete. The PAN filaments according to the invention are preferably suitable for production of V-resistant ropes, cordage, and covering materials of all types. Example covering materials are tarpaulins, canvases, etc., for the automobile industry or protective covers to protect surfaces and objects.

In addition, the PAN fibers according to the invention can be used to make non-woven fabrics, which are used as filters or geotextiles, for example.

Another preferred area of application for the PAN fibers according to the invention is production of friction coatings, especially brake linings.

What is claimed is:

1. Fibers of homopolymers or copolymers with a weight average molecular weight from 80,000 to 210,000, comprising at least 70% by weight of repeating acrylonitrile and/or methacrylonitrile units, characterized in that they are spun from a spinning solution, comprising at least 26%, by weight based on the spinning solution, of said homopolymers or copolymers and an organic aprotic solvent or a mixture of such solvents, into a coagulation bath, which is an aqueous mixture of an aprotic organic solvent, wherein the total drawing ratio is from 1:10 to 1:25, said fibers having a strength of more than 100 cN/tex, and an initial modulus of more than 15 N/tex, based on 100% elongation.

2. Fibers according to claim 1, characterized in that the homopolymers or copolymers comprise at least 90% by weight of acrylonitrile units.

3. Fibers according to claim 2, characterized in that the homopolymers or copolymers comprise at least 99% by weight of acrylonitrile units.

4. Fibers according to claim 1, characterized in that the fibers have a strength of 101 to 150 cN/tex.

5. Fibers according to claim 1, characterized in that the fibers have an initial modulus, based on 100% elongation, of 22 to 35 N/tex.

6. Fibers according to claim 5, characterized in that the fibers have an initial modulus, based on 100% elongation, of 22 to 30 N/tex.

7. Fibers according to claim 1, characterized in that the fibers have a tensile strength of more than 85 cN/tex.

8. Fibers according to claim 7, characterized in that the fibers have a tensile strength of more than 90 cN/tex.

9. Fibers according to claim 1, characterized in that the fibers have an elongation at break of not greater than 15%.

10. Fibers according to claim 9, characterized in that the fibers have an elongation at break of 7 to 9%.

11. Fibers according to claim 1, characterized in that the fibers have a single filament denier of 0.3 to 100 dtex.

12. Fibers according to claim 11, characterized in that the fibers have a single filament denier of 0.9 to 20 dtex.

13. Process for producing high-strength fibers of a homopolymer or copolymer comprising at least 70% by weight repeating acrylonitrile and/or methacrylonitrile units, comprising the following measures:

a) preparation of a spinning solution comprising an aprotic organic solvent or a mixture of such solvents and at least 15% by weight, based on the spinning solution, of a homopolymer or copolymer comprising at least 70% by weight repeating acrylonitrile and/or methacrylonitrile units, b) spinning this spinning solution by a wet-spinning process or a dry jet-wet-spinning process into a coagulation bath, with the spinning pressure of the spinning solution at the nozzle being at least 20 bar, c) coagulation of the spun fibers in the coagulation bath and drawing these fibers out of the coagulation bath, and d) post-treatment of the spun fibers by doing one or more drawing steps, in which the draw ratio between the take-up reel after the coagulation bath and the exit of the post-treatment segment is at least 1:10.

14. Process according to claim 13, characterized in that the solvent is selected from dimethyl sulfoxide (DMSO), dimethylacetamide (DMAC), N-methylpyrrolidone (NMP) and especially dimethyl formamide (DMF).

15. Process according to claim 13, characterized in that the concentration of the polymer in the spinning dope is more than 26%.

16. Process according to claim 15, characterized in that the concentration of the polymer in the spinning dope is 29 to 38%.

17. Process according to claim 13, characterized in that the viscosity of the spinning solution is at least 150 Pa.s, and especially 260–450 Pa.s (determined at 80° C. in DMF).

18. Process according to claim 13, characterized in that the spinning solution is filtered through a filter of 5–15 $\mu$m retention before spinning.

19. Process according to claim 13, characterized in that the temperature of the spinning solution ahead of the spinning nozzle is 80 to 130° C.

20. Process according to claim 13, characterized in that the nozzle orifice diameter is 60 to 150 $\mu$m.

21. Process according to claim 13, characterized in that the spinning speed is 5 to 50 meters/minute.

22. Process according to claim 13, characterized in that the spinning pressure of the spinning solution at the nozzle is at least 30 bar.

23. Process according to claim 13, characterized in that the spinning is done with a dry jet-wet spinning process, in which the width of the air gap between the spinning nozzle and the surface of the coagulation bath is 1 to 10 mm.

24. Process according to claim 13, characterized in that the coagulation bath is an aqueous mixture of the spinning solvent, in which the concentration of the spinning solvent is less than 75%, based on the coagulation bath.

25. Process according to claim 24, characterized in that the coagulation bath is an aqueous mixture of the spinning solvent, in which the concentration of the spinning solvent is less than 50%, based on the coagulation bath.

26. Process according to claim 25, characterized in that the coagulation bath is an aqueous mixture of the spinning solvent, in which the concentration of the spinning solvent is 20 to 50%, based on the coagulation bath.

27. Process according to claim 13, characterized in that the temperature of the coagulation bath is 20 to 110° C., preferably 40 to 90° C., and especially preferably 60 to 85° C.

28. A method for producing fiber-reinforced composite materials which comprises incorporating the fibers according to claim 1, into the composite materials.

29. The method according to claim 28, wherein the composite is a hydraulic setting material.

30. A method for producing a non-woven fabric which comprises bonding the fibers according to claim 1 together other than by weaving.

31. The method according to claim 30 wherein the fabric is a filter or a geotextile.

32. A method of producing friction coatings, which comprises incorporating the fibers according to claim 1 into the coatings.

33. A method of producing a rope or a cord which comprises joining together a plurality of fibers according to claim 1.

34. Composite material, nonwoven fabric, friction coating, rope, cord or covering material containing fibers according to claim 1.

35. A method of producing a covering material which comprises forming a layer by joining together a plurality of fibers according to claim 1.

* * * * *